US010145333B2

(12) United States Patent
Chu

(10) Patent No.: US 10,145,333 B2
(45) Date of Patent: Dec. 4, 2018

(54) CYLINDER HEAD INTEGRATED WITH EXHAUST MANIFOLD AND EGR COOLER

(71) Applicants: Hyundai Motor Company, Seoul (KR); Kia Motors Corp., Seoul (KR)

(72) Inventor: Dong Ho Chu, Whasung-Si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 1 day.

(21) Appl. No.: 15/246,764

(22) Filed: Aug. 25, 2016

(65) Prior Publication Data

US 2017/0145948 A1 May 25, 2017

(30) Foreign Application Priority Data

Nov. 20, 2015 (KR) ..... 10-2015-0163004

(51) Int. Cl.

| | |
|---|---|
| ***F02F 1/10*** | (2006.01) |
| ***F02F 1/40*** | (2006.01) |
| ***F02M 26/14*** | (2016.01) |
| ***F02M 26/22*** | (2016.01) |
| ***F02F 1/24*** | (2006.01) |

(52) U.S. Cl.

CPC ..... *F02F 1/40* (2013.01); *F02F 1/243* (2013.01); *F02M 26/14* (2016.02); *F02M 26/22* (2016.02)

(58) Field of Classification Search

CPC . F02F 1/40; F02F 1/243; F02M 26/14; F02M 26/22

USPC ..... 123/41.72

See application file for complete search history.

(56) References Cited

U.S. PATENT DOCUMENTS

| | | | | |
|---|---|---|---|---|
| 4,258,687 | A * | 3/1981 | Mauch | F01P 3/18 123/184.33 |
| 4,267,812 | A * | 5/1981 | Aula | F02B 47/08 123/184.33 |
| 7,069,918 | B2 * | 7/2006 | Mackey | F02B 75/22 123/568.12 |
| 7,625,257 | B1 * | 12/2009 | Broman | B63H 20/26 440/89 B |
| 8,056,545 | B2 * | 11/2011 | Feist | F02M 35/10157 123/195 C |
| 8,061,131 | B2 * | 11/2011 | Kuhlbach | F02F 1/243 123/193.5 |
| 8,146,543 | B2 * | 4/2012 | Kuhlbach | F02F 1/243 123/193.5 |

(Continued)

FOREIGN PATENT DOCUMENTS

| | | |
|---|---|---|
| JP | 2003-278609 A | 10/2003 |
| JP | 2007-138791 A | 6/2007 |

(Continued)

*Primary Examiner* — Hung Q Nguyen
*Assistant Examiner* — Anthony Taylor, Jr.
(74) *Attorney, Agent, or Firm* — Morgan, Lewis & Bockius LLP

(57) ABSTRACT

A cylinder head integrated with an exhaust manifold and an exhaust gas recirculation (EGR) cooler may include an exhaust manifold including a plurality of connection parts connected to a plurality of exhaust ports, respectively, and an extension part connected to a plurality of connection parts, a water jacket provided at a location adjacent to the exhaust manifold, and an EGR cooler communicating with the water jacket and configured to surround an outside of the extension part of the exhaust manifold.

6 Claims, 3 Drawing Sheets

(56) References Cited

U.S. PATENT DOCUMENTS

| | | | | |
|---|---|---|---|---|
| 8,528,529 | B2 * | 9/2013 | Ewen | F02M 26/25 123/568.12 |
| 8,936,012 | B2 * | 1/2015 | Asano | F02M 25/0735 123/568.12 |
| 9,470,133 | B2 * | 10/2016 | Kuhlbach | F02F 1/243 |
| 9,664,153 | B2 * | 5/2017 | Beyer | F02M 35/10222 |
| 9,689,303 | B2 * | 6/2017 | Harada | F01P 3/20 |
| 2009/0260605 | A1 * | 10/2009 | Janssen | F28F 27/02 123/568.12 |

FOREIGN PATENT DOCUMENTS

| | | | | | |
|---|---|---|---|---|---|
| JP | 2011-252441 | A | | 12/2011 | |
| JP | 2015-25421 | A | | 2/2015 | |
| KR | 2004-0025212 | A | | 3/2004 | |
| KR | 20040025212 | | * | 3/2004 | Y02T 10/121 |
| KR | 10-2008-0094379 | A | | 10/2008 | |
| KR | 20080094379 | A | * | 10/2008 | F01P 3/02 |
| KR | 10-2010-0060646 | A | | 6/2010 | |
| KR | 2012-0033118 | A | | 4/2012 | |

* cited by examiner

CYLINDER HEAD INTEGRATED WITH EXHAUST MANIFOLD AND EGR COOLER

CROSS REFERENCE TO RELATED APPLICATION

The present application claims priority to Korean Patent Application No. 10-2015-0163004, filed Nov. 20, 2015, the entire contents of which is incorporated herein for all purposes by this reference.

BACKGROUND OF THE INVENTION

Field of the Invention

The present invention generally relates to a cylinder head integrated with an exhaust manifold and an exhaust gas recirculation (EGR) cooler in a vehicle engine, wherein the exhaust manifold and the EGR cooler are inserted into the cylinder head and are integrated with the cylinder head.

Description of Related Art

Generally, an exhaust manifold is developed as an additional component separately from a cylinder head and is mounted to the cylinder head, thereby frequently causing thermal damage to a vehicle as well as affecting performance and durability of an engine. Thus, the exhaust manifold has been a major issue in a vehicle package.

An exhaust manifold requires a sufficient space within the engine room for its own disposal and additionally requires a sufficient gap between itself and neighboring components for preventing thermal damage to the neighboring components.

Further, a catalyst, which is disposed in the back of the exhaust manifold, needs to be disposed close enough to the engine so as to be rapidly activated. Thus, the exhaust manifold and the engine need to be disposed compactly.

In other words, in the case that the exhaust manifold as an additional structure is mounted to a cylinder head, an additional space for receiving the exhaust manifold is needed. In addition, a thermal barrier for preventing thermal damage should be provided. Thus, the exhaust manifold should be received within a restricted space in order to close the distance from the catalyst.

Consequently, the shape of the exhaust manifold should be dramatically modified in order to dispose the exhaust manifold within the restricted space. The dramatic modification in the shape of the exhaust manifold results in it being disposed at an increased distance from the catalyst, results in losses in performance, reduced thermal durability, etc. In the case that curvature of the shape of the exhaust manifold is dramatically changed, cracking may appear in a stress concentration area due to thermal fatigue.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cylinder head integrated with an exhaust manifold and an EGR (exhaust gas recirculation) cooler configured to be integrated by inserting both the exhaust manifold and the EGR cooler into the cylinder head of an engine, thereby realizing a simple layout and reducing manufacturing cost thereof.

According to various aspects of the present invention, a cylinder head integrated with an exhaust manifold and an exhaust gas recirculation (EGR) cooler may include an exhaust manifold including a plurality of connection parts connected to a plurality of exhaust ports, respectively, and an extension part connected to a plurality of connection parts, a water jacket provided at a location adjacent to the exhaust manifold, and an EGR cooler communicating with the water jacket and configured to surround an outside of the extension part of the exhaust manifold.

The exhaust manifold may be plural in number, the plurality of the exhaust ports may be arranged such that the plurality of exhaust ports is positioned along a lateral direction while being spaced apart at predetermined intervals.

The water jacket may be disposed at each of upper and lower portions of the exhaust ports.

The EGR cooler may have an inverse-U shape which is open at a lower portion thereof.

The extension parts of the exhaust manifold may be disposed to be overlapped in a vertical direction each other, and the EGR cooler may be configured to surround an outside of the extension parts, so the exhaust manifolds and the EGR cooler may be integrated with the cylinder head.

The cylinder head may further include a housing provided outside the EGR cooler for housing the EGR cooler.

The housing may be provided with an EGR gas inlet and an EGR gas outlet for allowing EGR gas to flow in and out of the EGR cooler, and an additional cover that is provided with the EGR gas inlet and the EGR gas outlet may be connected to the housing.

The extension parts of the plurality of exhaust manifolds may be disposed to be overlapped in a vertical direction each other, and the EGR cooler may be configured to surround an outside of the extension parts, so the exhaust manifolds and the EGR cooler may be integrated with the cylinder head.

The exhaust manifold may include a plurality of exhaust manifolds, extension parts of the plurality of exhaust manifolds may be disposed to be overlapped in a vertical direction each other, and the EGR cooler may be configured to surround the outside of the extension parts, so the exhaust manifolds and the EGR cooler may be integrated with the cylinder head.

According to the cylinder head integrated with the exhaust manifold and the EGR cooler configured as described above, the cylinder head is integrated with the exhaust manifold and the EGR cooler cylinder head by inserting the exhaust manifold and the EGR cooler into the cylinder head. Unlike a conventional EGR cooler, which is problematic in that a cooling fin of the EGR cooler is provided by being brazed outside stainless steel (SUS), and thus being expensive to manufacture, the cylinder head integrated with the exhaust manifold and the EGR cooler of the present invention is advantageous in that the housing of the EGR cooler can be made of the same material as the cylinder head, whereby it is possible to realize a simple layout and to reduce manufacturing cost thereof.

Further, the cylinder head integrated with the exhaust manifold and the EGR cooler of the present invention is advantageous in that a pipe, which is used to make the mounting surface of the cylinder head where the exhaust manifold is mounted and the connection area of the EGR cooler, can be removed or shortened in length by using the same material as the cylinder head. Thus, assembly time thereof can be reduced, whereby it is possible to reduce manufacturing cost.

When an EGR valve is operated at a beginning of a cold start of the engine during drive of a vehicle, a coolant cools EGR gas, whereby the temperature of the coolant is relatively raised. Thus, temperature losses of exhaust gas are relatively reduced, whereby the temperature of the exhaust gas that flows in front of a catalyst is relatively high, and thus it is possible to raise a catalyst activation temperature to a relatively high point. Further, a solenoid valve may be provided in a part that is operated by the EGR cooler in the cylinder head at the beginning of the cold start so that the coolant can be controlled not to flow by closing the solenoid valve at the beginning of the cold start. Thereby, it is possible to minimize the temperature losses of the exhaust gas caused by a circulation of the coolant. Therefore, it is possible to minimize a temperature decrease of the exhaust gas that flows in front of the catalyst, thereby reducing time for raising the catalyst activation temperature and realizing improved emissions. Alternatively, a variable flow control valve instead of the solenoid valve may be provided for preventing the coolant from flowing at the beginning of the cold start.

Further, a pipe for an EGR path may be removed or the length thereof may be shortened, thereby minimizing a difference in pressure via shortening the length of a connection passage. Thus, the EGR can be applied to a low speed/low load range, whereby efficiency of the engine can be improved by improving suction efficiency. Therefore, gas mileage can be improved.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
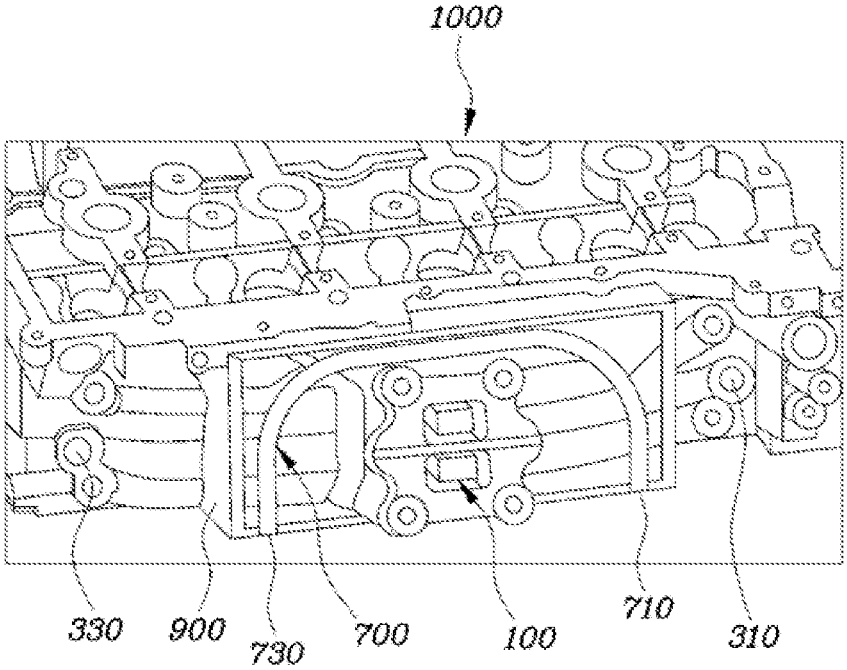
FIG. 1 is a view showing an exemplary cylinder head integrated with an exhaust manifold and an EGR cooler according to the present invention.
Figure 1:
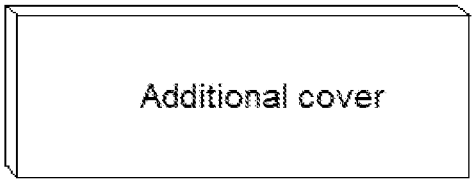
Figure 2:
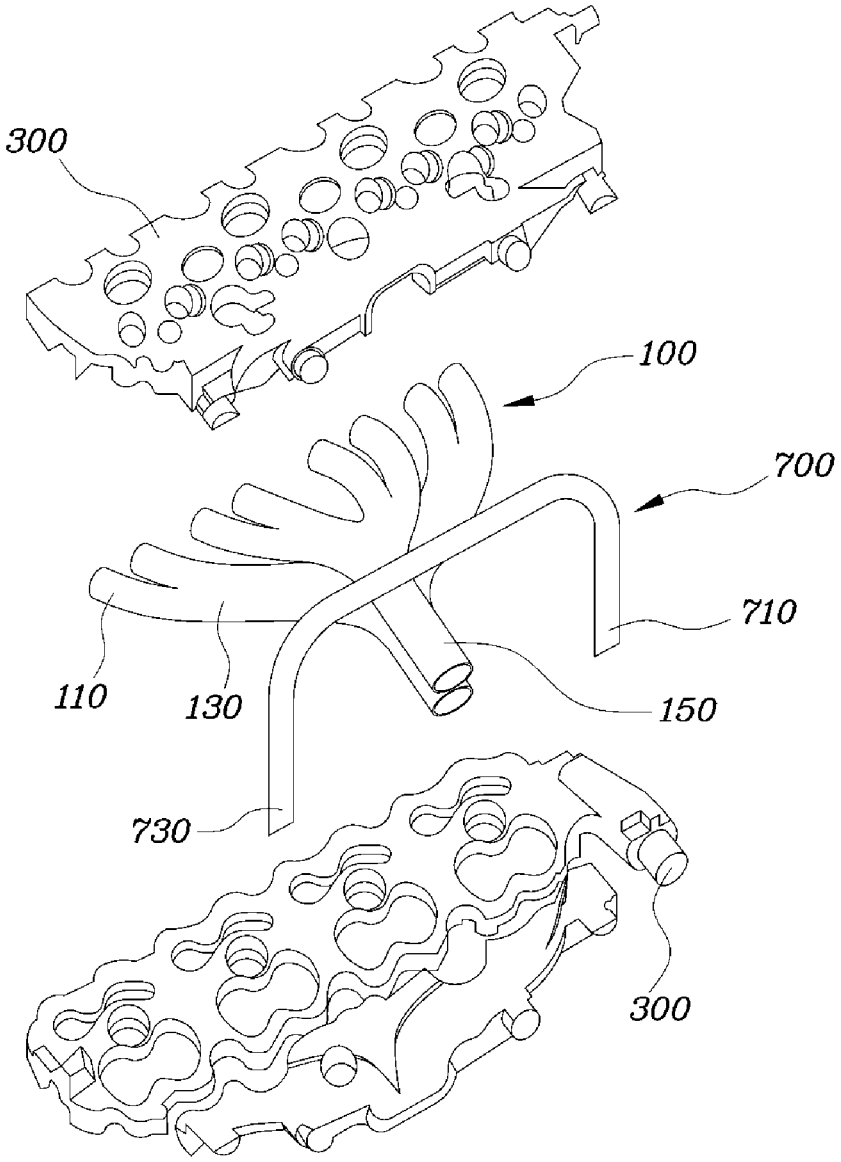
FIG. 2 is a view showing the exemplary exhaust manifold and the EGR cooler of FIG. 1 in detail.
Figure 3:
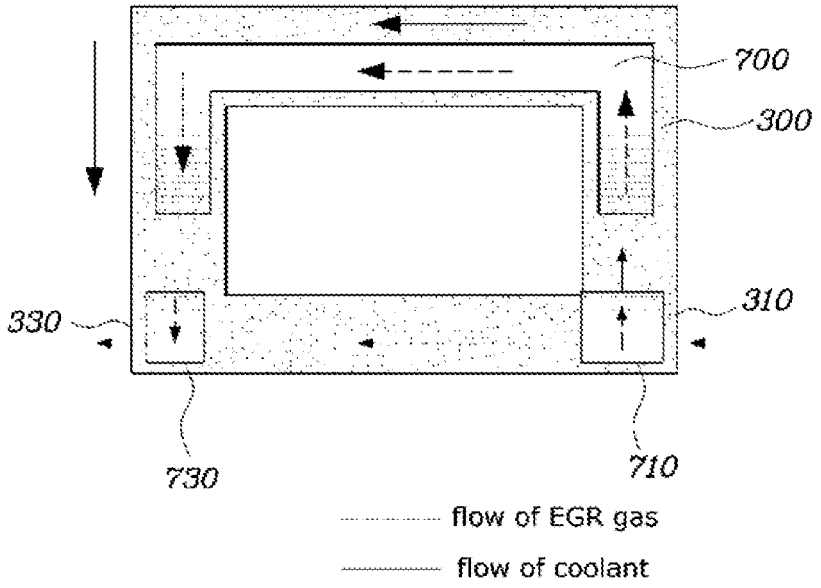
FIG. 3 is a schematic view showing a flow of EGR gas and a coolant.

FIG. 1 is a view showing a cylinder head integrated with an exhaust manifold and an EGR cooler according to various embodiments of the present invention. FIG. 2 is a view showing the exhaust manifold 100 and the EGR cooler 700 of FIG. 1 in detail. FIG. 3 is a schematic view showing a flow of EGR gas and coolant.

Disclosed is a cylinder head of a four-cylinder in-line engine, but the engine is not limited to the four-cylinder in-line engine. Further, it is already known that the exhaust manifold is integrally inserted into the cylinder head, so detailed description thereof will be omitted. Thus, reference will be made to the integration of the EGR cooler into the cylinder head in detail.

The cylinder head integrated with the exhaust manifold and the EGR cooler according to the various embodiments of the present invention includes an exhaust manifold 100 including a connection part 130 connected with a plurality of exhaust ports 110, and an extension part 150 connected with a plurality of connection parts 130, a water jacket 300 provided at a location adjacent to the exhaust manifold 100, and an EGR cooler 700 communicating with the water jacket 300 and configured to surround an outside of the extension part 150 of the exhaust manifold 100.

Two exhaust ports 110 are provided in one cylinder. Accordingly, the engine has four cylinders, so a total of eight exhaust ports 110 are provided. Two exhaust ports 110 make a pair per each cylinder, and are connected with each other at the connection part 130. Two connection parts 130 form one extension part 150. In particular, as shown in FIG. 2, the exhaust ports 110 that are provided in second and third cylinders may form one exhaust manifold 100, and the exhaust ports 110 that are provided in first and fourth cylinders may form another exhaust manifold 100. Further, the exhaust manifold 100 is configured such that exhaust ports 100 are positioned along a lateral direction while being spaced apart from each other at predetermined intervals. Further, the extension part 150 that extends from the exhaust manifold 100 connected with the second and the third cylinder and the extension part 150 that extends from the exhaust manifold 100 connected with the first and the fourth cylinder may be disposed to be overlapped in a vertical direction each other, whereby it is advantageous to design, to manufacture, to use of space, etc.

The exhaust manifold 100 needs to be cooled because high temperature burnt exhaust gas passes therethrough in a combustion chamber of the engine. Thus, the water jacket 300 is provided at a location adjacent to the exhaust manifold 100. The water jacket 300, like the exhaust manifold 100, is inserted into the cylinder head 1000, wherein the water jacket 300 may be provided at each of upper and lower portions of the exhaust ports 110 so as to quickly cool the exhaust manifold 100.

Generally, the extension part 150 of the exhaust manifold 100 protrudes toward a front side of a vehicle. Thus, the EGR cooler is shaped as an inverse-U shape being open at a lower portion thereof. An EGR cooler 700, which is in an inverse-U shape being open at a lower portion thereof and communicating with the water jacket 300, is configured to surround an outside of the extension part 150 of the exhaust manifold, so the EGR cooler 700 is integrated with the cylinder head 1000.

In other words, a conventional water jacket that is disposed between the exhaust manifold 100 of the second and the third cylinder, and the exhaust manifold 100 of the first and fourth cylinder is removed. Instead, a capacity and an area of the water jacket 300 that is provided at the lower portion of the exhaust ports 110 are increased so as to be capable of maintaining cooling effect and allowing the EGR cooler 700 to be inserted into the cylinder head 1000.

To be more specific, the cylinder head 1000 is provided with a housing 900 outside the extension part 150 of the exhaust manifold 100, wherein the EGR cooler 700 is inserted into the housing 900, whereby the EGR cooler 700 is integrated with the cylinder head 1000. Further, the housing 900 is provided with an EGR gas inlet 710 and an EGR gas outlet 730 for allowing EGR gas to flow in and out of the EGR cooler 700, wherein an additional cover that is provided with the EGR gas inlet 710 and the EGR gas outlet 730 may be connected to the housing 900. Thus, as shown in FIG. 3, a temperature of a coolant flowing from a coolant inlet 310 of the water jacket 300 is raised while passing through the EGR cooler 700, and then the coolant flows out through the coolant outlet 330.

A path for the EGR gas can be connected by using a same material as the cylinder head 1000 or by making a connection area using a pipe. A sealing cap may be applied to an area made of the same material as the cylinder head 1000, thereby reducing leakage of the coolant.

Thus, the conventional EGR cooler 700 is problematic in that a cooling fin of the EGR cooler 700 is provided by being brazed outside stainless steel (SUS), thus manufacturing cost is relatively high. However, the cylinder head integrated with the exhaust manifold and the EGR cooler is advantageous in that the housing 900 of the EGR cooler 700 can be made of the same material as the cylinder head 1000, whereby it is possible to realize a simple layout and to reduce manufacturing cost thereof.

Further, the cylinder head integrated with the exhaust manifold and the EGR cooler is advantageous in that a pipe, which is used to make a mounting surface on the cylinder head 1000 where the exhaust manifold 100 is mounted and which is used to make the connection area of the EGR cooler 700, can be removed or shortened in length by using the same material as the cylinder head 1000. Thus, assembly time thereof can be reduced, whereby it is possible to reduce manufacturing cost.

When an EGR valve is operated at a beginning of a cold start of the engine, the coolant cools EGR gas, whereby a temperature of the coolant is raised. Thus, temperature losses of exhaust gas are reduced, whereby a temperature of the exhaust gas that flows in front of a catalyst is relatively high, and thus it is possible to raise a catalyst activation temperature to a relatively high point. Further, a solenoid valve may be provided in a part that is operated by the EGR cooler 700 in the cylinder head 1000 at the beginning of the cold start so that the coolant can be controlled not to flow by closing the solenoid valve at the beginning of the cold start. Thereby, it is possible to minimize the temperature losses of the exhaust gas caused by a circulation of the coolant. Therefore, it is possible to minimize a temperature decrease of the exhaust gas that flows in front of the catalyst, thereby reducing time for raising the catalyst activation temperature and improving emissions. Alternatively, a variable flow control valve instead of the solenoid valve may be provided for preventing the coolant from flowing at the beginning of the cold start.

Further, a pipe for an EGR path may be removed or the length thereof may be shortened, thereby minimizing a difference in pressure via shortening the length of a connection passage. Thus, the EGR can be applied to a low speed/low load range, whereby efficiency of the engine can be improved by improving suction efficiency. Therefore, gas mileage can be improved.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cylinder head integrated with an exhaust manifold and an exhaust gas recirculation (EGR) cooler, the cylinder head comprising:

the exhaust manifold including a plurality of connection parts connected to a plurality of exhaust ports, respectively, and at least one extension part connected to each of the plurality of connection parts;

a water jacket provided at a location adjacent to the exhaust manifold, such that the EGR cooler is in thermal communication with the water jacket, the EGR cooler being disposed around an outer portion of the at least one extension part of the exhaust manifold, and wherein the at least one extension part of the exhaust manifold extends out of the water jacket;

wherein the EGR cooler extends from a first lower side of the at least one extension part toward an upper side of the at least one extension part and then across the upper side of the at least one extension part to a second lower side of the at least one extension part, thereby forming an inverse-U shape around the outer portion of the at least one extension part of the exhaust manifold.

2. The cylinder head of claim 1, wherein the exhaust manifold includes a plurality of exhaust manifolds having a plurality of extension parts, the plurality of exhaust ports being arranged such that the plurality of exhaust ports are positioned along a lateral direction with respect to the cylinder head while being spaced apart at predetermined intervals.

3. The cylinder head of claim 1, wherein the water jacket is disposed at each of upper and lower portions of the plurality of exhaust ports.

4. The cylinder head of claim 2, wherein the plurality of extension parts of the plurality of exhaust manifolds are disposed such that said plurality of extension parts are overlapped in a vertical direction of each other, and the EGR cooler is configured to surround an outer portion of the plurality of extension parts, such that the plurality of exhaust manifolds and the EGR cooler are integrated with the cylinder head.

5. The cylinder head of claim 1, further comprising a housing provided outside the EGR cooler for housing the EGR cooler.

6. The cylinder head of claim 5, wherein:

the housing is provided with an EGR gas inlet and an EGR gas outlet for the EGR cooler to allow EGR gas to flow in and out of the EGR cooler; and an additional cover that is provided with the EGR gas inlet and the EGR gas outlet is connected to the housing.

* * * * *